US007623799B2

(12) United States Patent
Shishikura et al.

(10) Patent No.: US 7,623,799 B2
(45) Date of Patent: Nov. 24, 2009

(54) IMAGE FORMING APPARATUS

(75) Inventors: Shunichiro Shishikura, Kanagawa (JP); Shigeru Tsukada, Kanagawa (JP); Naoya Yamasaki, Kanagawa (JP); Masayuki Aratake, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 530 days.

(21) Appl. No.: 11/350,865

(22) Filed: Feb. 10, 2006

(65) Prior Publication Data

US 2006/0291873 A1 Dec. 28, 2006

(30) Foreign Application Priority Data

Jun. 23, 2005 (JP) ..... P2005-182856

(51) Int. Cl.
*G03G 15/00* (2006.01)
*G03G 15/01* (2006.01)

(52) U.S. Cl. ..... 399/13; 399/227

(58) Field of Classification Search ..... 399/13, 399/27, 227

See application file for complete search history.

(56) References Cited

U.S. PATENT DOCUMENTS

| | | | | |
|---|---|---|---|---|
| 5,918,092 | A | 6/1999 | Hama | 399/227 |
| 6,201,939 | B1 | 3/2001 | Yamamoto et al. | 399/99 |
| 2005/0100355 | A1* | 5/2005 | Suzuki et al. | 399/27 |
| 2005/0129418 | A1 | 6/2005 | Imamiya et al. | |
| 2006/0067738 | A1 | 3/2006 | Ohara et al. | 399/227 |

FOREIGN PATENT DOCUMENTS

| | | | |
|---|---|---|---|
| CN | 1627199 | A | 6/2005 |
| JP | 04-349480 | | 12/1992 |
| JP | 04349480 | A * | 12/1992 |
| JP | 5-313495 | | 11/1993 |
| JP | 07-225513 | | 8/1995 |
| JP | 2000-227707 | | 8/2000 |
| JP | 2000-231255 | | 8/2000 |
| JP | 2000287090 | A * | 10/2000 |
| JP | 2001-134044 | | 5/2001 |
| JP | 3170500 | B | 5/2001 |
| JP | 2001-166557 | | 6/2001 |
| JP | 2001-175131 | | 6/2001 |
| JP | 3170501 | B | 6/2001 |

* cited by examiner

*Primary Examiner*—David M Gray
*Assistant Examiner*—Erika Villaluna
(74) *Attorney, Agent, or Firm*—Morgan Lewis & Bockius LLP

(57) ABSTRACT

An image forming apparatus comprises: a rotary unit having a plurality of development devices provided around a rotary shaft, the development device including a constituent unit, wherein the plurality of the development devices move to a development position where the development devices sequentially oppose an image carrier by rotation of the rotary unit, and the development device in the development position develops an electrostatic latent image on the image carrier, a state detection unit that is disposed at a position above a circumference of the rotary unit, the position being different from the development position and that detects at least one of a state of the development devices and a state of the constituent unit of the development devices; and a rotation control unit that controls the rotary unit so as to perform rotation of the rotary unit for sequentially moving the development devices to the development position and rotation of the rotary unit for sequentially moving the development devices to a detection position during the same rotation.

1 Claim, 5 Drawing Sheets

IMAGE FORMING APPARATUS

CROSS-REFERENCE TO RELATED APPLICATIONS

This application is based on and claims the benefit of priority from the prior Japanese Patent Application No. 2005-182856, filed on Jun. 23, 2005; the entire contents of which are incorporated herein by reference.

BACKGROUND OF THE INVENTION

1. Technical Field of the Invention

The present invention relates to an electrophographic image forming apparatus which enables printed output of a visible image on a recording medium by developing an electrostatic latent image on an image carrier through a development device.

2. Description of the Related Art

An image forming apparatus compatible with a color image has recently become widely prevalent. An image forming apparatus compatible with a color image have four development devices assigned to respective color components of YMCK, and a rotary (revolving body) unit around which the development devices are provided. In the image forming apparatus having such a configuration, the respective development devices integrally rotate in association with rotation of the rotary unit, whereby the development devices sequentially move to a development position where the development device faces a photosensitive drum which is an image carrier. Consequently, after having developed an electrostatic latent image on the photosensitive drum as a toner image, the development device located in the development position transfers the toner image to an intermediate transfer body, or the like. These operations are sequentially repeated such that the toner images formed by the respective development devices are superposed one on top of the other on the intermediate transfer body or the like, so that a transfer image corresponding to the color image is formed on the intermediate transfer body or the like.

In the electrophotographic image forming apparatus, the electrostatic latent image on the photosensitive drum is generally developed as a toner image. Accordingly, the concentration of toner, the amount of toner, and the amount of remaining toner, and the like greatly affect the image quality of a formed image. In view of this, an image forming apparatus, which has a rotary unit and is compatible with a color image, has hitherto been proposed to detect and monitor—through use of a custom-designed sensor, or the like—the concentration of toner, the amount of remaining toner, a determination as to whether or not the development device is attached to a predetermined position within the rotary unit, a determination as to whether or not a toner cartridge, which is a constituent unit of the development device, is attached, and the like, whereby the image quality of the formed image can be maintained well.

According to the above-related art, an image forming apparatus having a rotary unit requires rotation of the rotary unit in order to detect the state of a development device, such as the concentration of toner, the amount of remaining toner, and presence/absence of the development device, or the state of a constituent unit of the development device such as presence/absence of a toner cartridge. Specifically, separately from rotation of the rotary unit required by each development device in the rotary unit to develop an electrostatic latent image on the photosensitive drum, rotation of an individual rotary unit for detecting the state of each development device or the state of a constituent unit of the development device is required. Consequently, the productivity achieved through image formation may be degraded by an amount corresponding to the time required by the individual rotary unit to rotate.

SUMMARY OF INVENTION

The present invention has been made in view of the above circumstances and provides an image forming apparatus.

According to an aspect of the invention, an image forming apparatus comprises h a rotary unit having a plurality of development devices provided around a rotary shaft, the development device including a constituent unit, wherein a plurality of the development devices move to a development position, where the development devices sequentially oppose an image carrier by rotation of the rotary unit, and a development device in the development position develops an electrostatic latent image on the image carrier, a state detection unit that is disposed at a position above a circumference of the rotary unit, the position being different from the development position, and that detects at least one of a state of the development devices and a state of the constituent unit of the development devices at a detection position; and a rotation control unit that controls the rotary unit so as to perform rotation of the rotary unit for sequentially moving the development devices to the development position and rotation of the rotary unit for sequentially moving the development devices to a detection position during the same rotation.

BRIEF DESCRIPTION OF THE DRAWINGS

These and other objects and advantages of this invention will become more fully apparent from the following detailed description taken with the accompanying drawings in which.

DESCRIPTION OF THE EMBODIMENTS

Examples of image forming apparatus will be described hereinbelow by reference to the drawings.

Figure 1A:
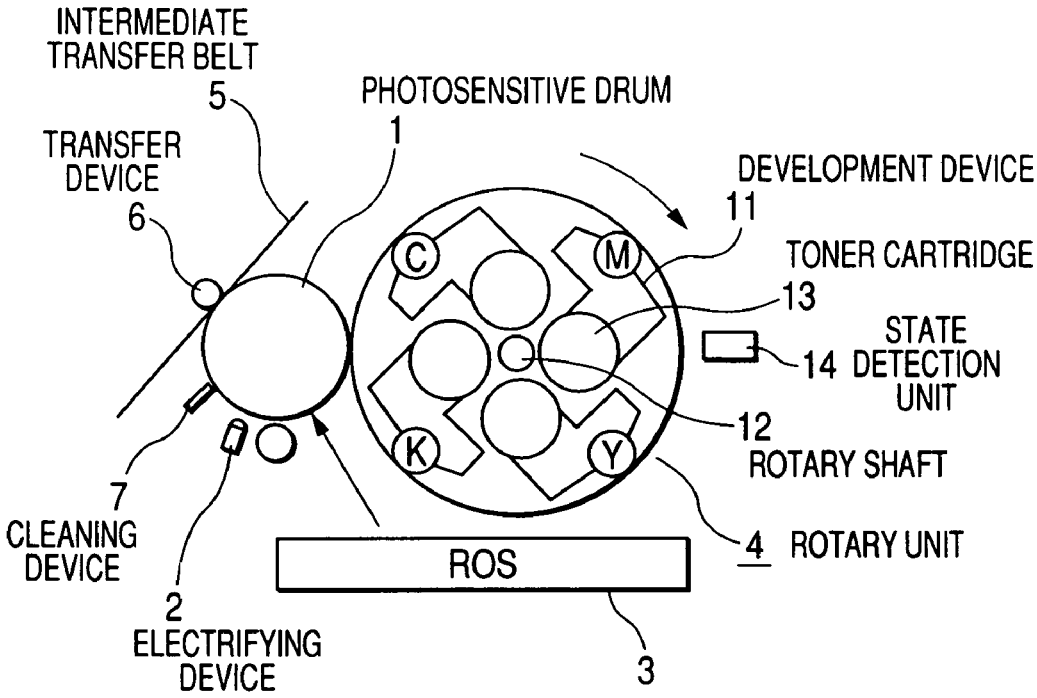
FIGS. 1A and 1B are descriptive views showing the principal configuration of an image forming apparatus according to an example.
Figure 1B:
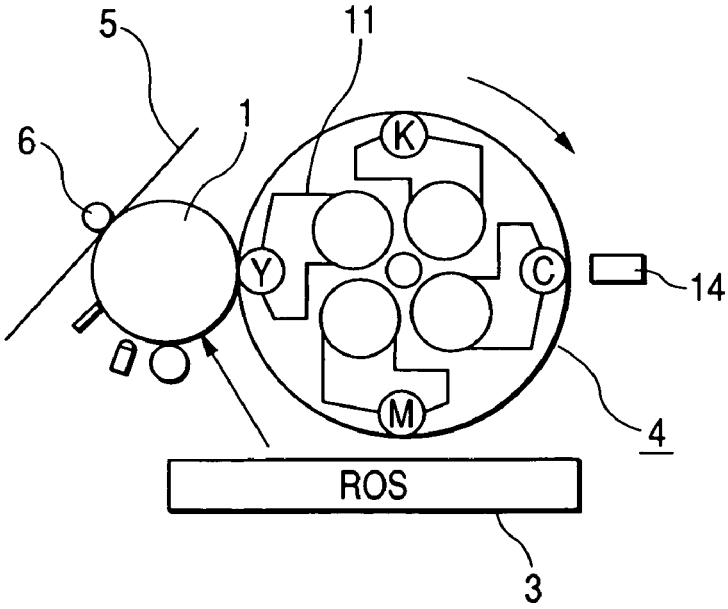

FIGS. 1A and 1B are descriptive views showing the principal configuration of an example image forming apparatus. As illustrated, the image forming apparatus to be described herein comprises a photosensitive drum 1 serving as an image carrier; an electrifying device 2 for electrifying the photosensitive drum 1; an ROS (Raster Output Scanner) 3 which writes an electrostatic latent image on the photosensitive drum 1 through exposure; a rotary unit 4 having a development device for developing an electrostatic latent image on the photosensitive drum 1 as a toner image; a transfer device 6 for transferring the toner image on the photosensitive drum 1 onto an intermediate transfer belt 5; and a cleaning device 7 for removing the toner remaining on the photosensitive drum 1.

Of these elements, the rotary unit 4 has four development devices 11 assigned to respective Y, M, C, K color components so as to enable formation of a color image, and has the development devices 11 disposed around a rotary shaft 12. As a result of the rotary unit 4 rotating around the rotary shaft 12, the respective development devices 11 rotate in an integrated fashion. Rotation of the rotary unit 4 is performed by an unillustrated drive source such as a motor, and rotational driving of the rotary unit 4 is controlled by rotation control unit, such as a motor controller or the like, which is also unillustrated. Specifically, under drive control of the rotation control unit, the rotary unit 4 starts rotation and halts rotation at a desired position. In relation to the technique for controlling driving of the rotary unit performed by the rotation control unit, it is better to utilize a known technique, and therefore its explanation is omitted.

Each of the development devices 11 attached to the rotary unit 4 employs toner which is, e.g., a well-known two-component developing agent for developing the electrostatic latent image on the photosensitive drum 1. Therefore, each of the development devices 11 has a toner cartridge 13, as a constituent unit of the development device, for storing toner assigned to any of color components Y (yellow), M (magenta), C (cyan), and K (black). In order to facilitate replenishment of toner, the toner cartridge 13 is configured to be removably attached to the development device 11. The development device 11 is also configured so as to be removably attached to the rotary unit 4 in order to facilitate maintenance of the development device. The mechanism that enables removable attachment of a toner cartridge is realized by utilization of the well-known technique. Therefore, its explanation is omitted.

The respective development devices 11 attached to the rotary unit 4 are provided around the rotary unit 4 such that an arrangement pitch on the circumference of the rotary unit 4 becomes uniform. Specifically, the development devices 11 attached to the rotary unit 4 are four, and hence the circumferential length of the rotary unit 4 is split into four uniform lengths by these development devices 11.

As shown in FIG. 1A, in the image forming apparatus having the rotary unit 4 of such a configuration, the rotary unit 4 becomes stationary at the home position, during the halt of the image forming apparatus, where none of the development devices 1 faces the photosensitive drum 1, in order to alleviate the burden imposed on the photosensitive drum 1 or the like. The rotary unit 4 starts rotation while pursuing drive control of the rotation control unit. As shown in FIG. 1B, when any one of the development units 11 has moved to the development position where the development device opposes the photosensitive drum 1, rotation of the rotary unit 4 is stopped, and the development device located at the development position (e.g., the development device 11 assigned to the Y-color component) develops the electrostatic latent image on the photosensitive drum 1 by a toner image. The toner image that has been formed on the photosensitive drum 1 by this developing operation is transferred onto the intermediate transfer belt 5 by the transfer device 6.

Thus, after the electrostatic latent image of one color component on the photosensitive drum 1 has been developed, the rotary unit 4 is again rotated to thus cause the development device assigned to the next color component to come to the development position. Likewise, the electrostatic latent image of that color component is developed. At that time, rotation of the rotary unit 4, rotation of the photosensitive drum 1, transfer of an image on the intermediate transfer belt 5, and the like, are performed at timing when a toner image of previous color and a toner image of the next color precisely overlap each other on the intermediate transfer belt 5.

So long as processing operations, such as those mentioned previously, are repeatedly performed for each of the development devices 11 by a single rotation of the rotary unit 4, a full color image, into which the Y, M, C, K color components have been merged, is formed on the intermediate transfer belt 5. Specifically, during formation of a color image, a plurality of the development devices 11 are sequentially moved to the development position where the development device 11 opposes the photosensitive drum 1, by a single rotation of the rotary unit 4, thereby causing each of the development devices 11 to develop the electrostatic latent image on the photosensitive drum 1.

However, when the electrostatic latent image on the photosensitive drum 1 is developed by the toner image, the concentration of toner, the amount of remaining toner, and the like, greatly affect the image quality achieved through image formation. For this reason, a state detection unit 14 is disposed at a position above the circumference of the rotary unit 4 for detecting either the state of the development devices 11 attached to the rotary unit 4 or the state of constituent units of the development devices 11. The state detection unit 14 is disposed at a position different from the development position where each of the development devices 11 opposes the photosensitive drum 1, because of restrictions on the space around the photosensitive drum 1 and the rotary unit 4.

The state of the development device 11 detected by the state detection unit 14 refers to the state of a matter which affects operation for developing an electrostatic latent image. Specifically, the state includes the concentration of toner used for developing an electrostatic latent image, the amount of remaining toner, presence/absence of the development device 11 in the rotary unit 4, specifics of attribute information stored in the development devices 11, and the like.

As in the case of the state of the development device 11, the state of the constituent unit of the development unit 11 detected by the state detection unit 14 refers to a matter which affects the operation for developing an electrostatic latent image. Specifically, the state of the constituent unit includes the presence/absence of the toner cartridge 13 comprising the development device 11.

The state detection unit 14 may be a sensor which detects at least one of the state of the development device 11 and the state of the constituent unit of the development device 11. Specifically, the state detection unit 14 maybe a sensor which detects any one of the above matters or a sensor which detect a plurality of matters in combination.

FIG. 2A-2E are descriptive views showing a specific example of the state detection unit.

Figure 2A:
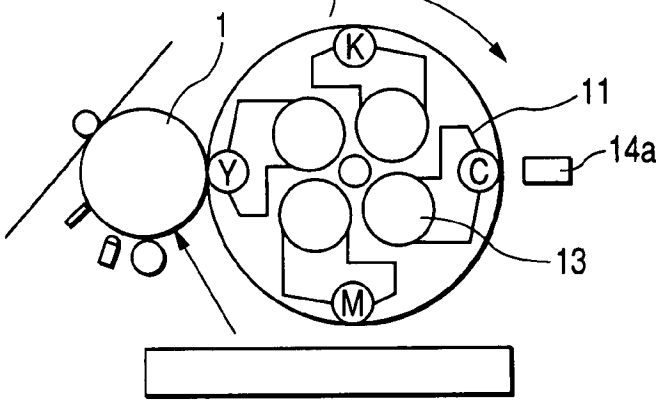
FIG. 2A-2E are descriptive views showing a state of the detection unit.

For instance, as shown in FIG. 2A, if the matter to be detected is the concentration of toner, a diffused light sensor 14*a* is conceived to be disposed at a position above the circumference of the rotary unit 4, to thus detect in a noncontact manner the concentration of toner of each development device 11 located in the detection position where the development device opposes the diffused light sensor 14*a*. As a matter of course, another well-known technique may be utilized for detecting the concentration of toner.

Figure 2B:
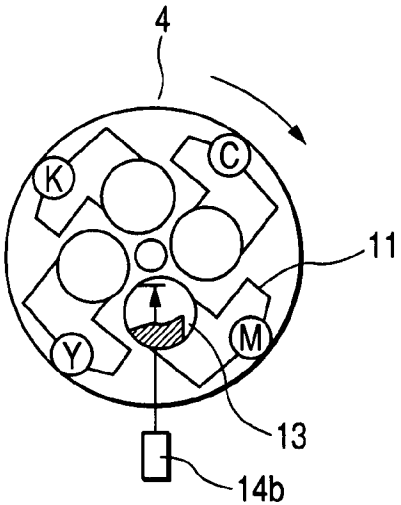

As shown in FIG. 2B, if the matter to be detected is the amount of remaining toner, a transmission optical sensor 14*b* is conceived to be disposed at a position above the circumference of the rotary unit 4; transparent windows of the toner cartridges 13 are conceived to be provided in the respective development devices 11; and reflection surfaces are conceived to be provided on inner wall surfaces of the cartridges that can be viewed through the transparent windows. In relation to the respective development devices 11 located in the detection position opposing the transmission optical sensor 14, the amount of toner remaining in the toner cartridge is conceived to be detected in a noncontact manner. Another well-known technique may be utilized for detecting the amount of remaining toner.

Figure 2C:
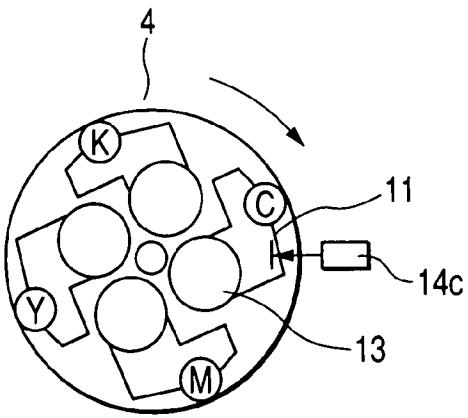
Figure 2D:
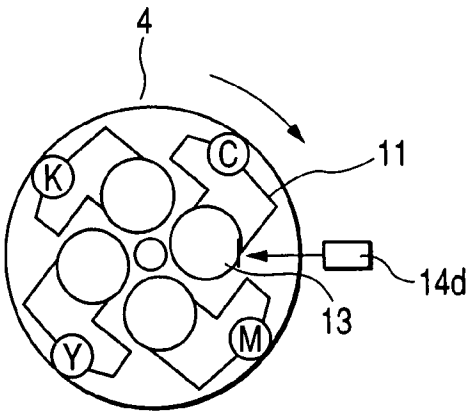

For instance, when the matter to be detected is presence/absence of the development device 11 or presence/absence of the toner cartridge 13, reflection optical sensors 14*c*, 14*d* are disposed at positions above the circumference of the rotary unit 4, as shown in FIG. 2C or 2D. Each of the development devices 11 or each of the toner cartridges 13, which are to become objects of sensing, is conceived to be provided with a reflection plate, to thus detect, in a noncontact manner, presence/absence of the respective development devices 11 or the toner cartridges 13 located in the detection position where the development device or the toner cartridge opposes the reflection optical sensors 14*c*, 14*d*. Another well-known technique may also be utilized for detecting presence/absence of the development device or the toner cartridge.

Figure 2E:
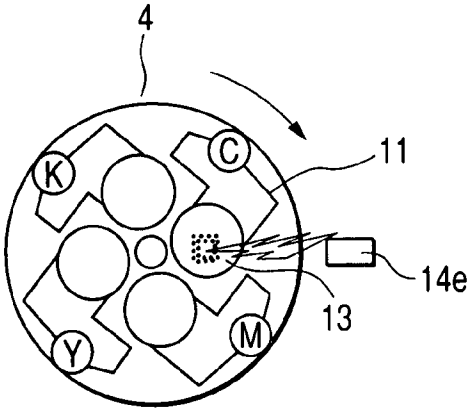

For instance, as shown in FIG. 2E, in a case where the matter to be detected is specifics of attribute information about the development device 11, the following detection method is conceivable. Namely, an electromagnetic communication unit 14*e* is provided at a position above the circumference of the rotary unit 4. A radio wave emitted from the communication unit 14*e* is converted into energy, whereby data are exchanged, in a noncontact manner, with respect to memory of the development device 11 located in the detection position where the development device opposes the communication unit 14*e*. Thus, the attribute information stored in the memory can be conceived to be detected. The attribute information stored in memory includes manufacturing information, such as a manufacturing lot of toner stored in the toner cartridge 13, the amount of toner filled in the toner cartridge, the date of manufacture of toner in the toner cartridge, a shape factor of toner, a mean particle size, an initial physical characteristic (an electrifying characteristic), and the like. These pieces of manufacturing information have already been written in memory at shipment of a product from the factory. In addition, the attribute information includes history information, such as the number of pages having undergone image formation performed by the image forming apparatus (a developing machine or a toner cartridge), a driving time, and temperature-humidity history. These pieces of history information are assumed to be written into memory by way of the communication unit 14*e* as appropriate according to an operating condition of the image forming apparatus. Exchange of data by way of the communication unit 14*e* is implemented by utilization of the well-known technique. Therefore, its explanation is omitted here.

[Description of the Basic Configuration of Another Example]

Another example configuration of the image forming apparatus will now be described. Only a difference between the present example configuration and the above-described configuration example will be described.

FIG. 3 is a descriptive view showing the principal configuration of another example image forming apparatus. As illustrated, the image forming apparatus described herein differs from that of the above-described configuration example in that a plurality of the development devices 11 provided on the rotary unit 4 are arranged such that pitches between the development devices 11 on the circumference of the rotary unit 4 become nonuniform.

In general, the image forming apparatus compatible with a color image also has the potential for forming a monochrome image as well as a color image. For this reason, the amount of consumed toner of Y, M, C, K color components is not always uniform. In relation to toner of color components which are consumed in large amounts, an increase in the volume of toner cartridge in the developing machine is effective for lessening the frequency of replenishment of toner.

Therefore, in the image forming apparatus described here, the volume of the toner cartridge 13 for the development device 11 assigned to a color component whose toner is consumed in a large amount, specifically, toner of K color component, is made larger than that of the development devices 11 assigned to the other color components. Therefore, in association with an increase in the volume of the toner cartridge, pitches at which the development devices 11 are arranged become nonuniform with the development devices 11 attached to the rotary unit 4.

[Description of an Example Basic Processing Operation]

Next, an example characteristic processing operation of the image forming apparatus will be described. Example processing for a case where the development devices 11 are arranged at nonuniform pitches will now be described by reference to FIG. 3A-3G. No substantial discrepancy exists between a case where the development devices 11 are provided at a uniform pitch, such as that shown in FIGS. 1A and 1B, and the case of the nonuniform pitches, and hence its explanation is omitted.

Processing operation of the image forming apparatus to be described herein is characterized in that there are performed, in the same rotation, rotation of the rotary unit 4 for sequentially moving the respective development devices 11 to the development position to thus develop an electrostatic latent image on the photosensitive drum 1 and rotation of the rotary unit 4 for sequentially moving the respective development units 11 to the detection position to thus cause the state detection unit 14 to detect the state of the development device 11 or the state of the toner cartridge 13, which is a constituent unit of the development device. Here, the term "same rotation" means a single identical rotation. Specifically, when the rotary unit 4 has rotated once, the respective development devices 11 sequentially move to the development position, where the respective development devices become able to develop the electrostatic latent image on the photosensitive drum 1. However, in association with sequential movement, the respective development devices 11 sequentially move to the detection position. Accordingly, at a point in time when the respective development devices 11 have moved to the detection position, the state detection unit 14 detects the state of the development device 11 situated in the detection position or the state of the toner cartridge 13 of that development device 11.

Figure 3C:
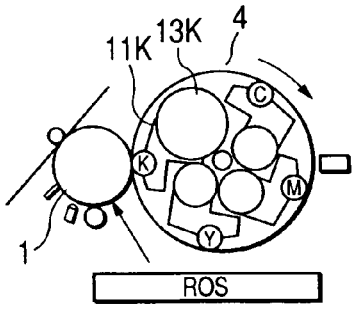
FIG. 3A-3I are descriptive views showing the principal configuration of an image forming apparatus according to another example.
Figure 3D:
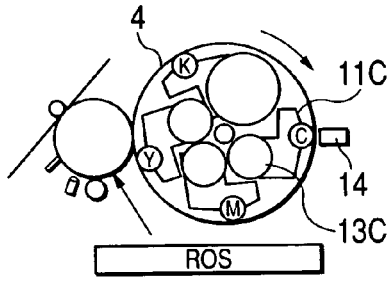

Specifically, processing operation, which will be described below, is performed. As shown in FIG. 3A, the rotary unit 4 is situated in the home position before commencement of processing operation. Therefore, the positions of the respective development devices 11 coincide with neither the development position nor the detection position.

Figure 3B:
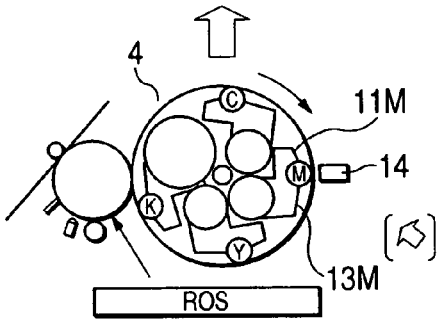

When the rotary unit 4 has started rotating in, e.g., a clockwise direction in the drawing, the development device 11M assigned to the M-color component arrives at the detection position, as shown in FIG. 3B. Here, the rotary unit 4 temporarily halts its rotation. The state detection unit 14 detects the state of the development device 11M, which has been temporarily stopped in the detection position and is assigned to the M-color component, or the state of the toner cartridge 13M of the development device 11M.

After detecting the state in connection with the M-color component has been completed, the rotary unit 4 resumes its rotation. As shown in FIG. 3C, the development device 11K assigned to the K-color component arrives at the development position as a result of rotation of the rotary unit 4. Thereby, the development device 11K assigned to K-color component becomes able to develop the electrostatic latent image on the photosensitive drum 1.

As shown in FIG. 3D, after operation for developing the electrostatic latent image of the K-color component has been completed, the development device 11C assigned to the C-color component arrives at the detection position as a result of rotation of the rotary unit 4 being resumed. Here, the rotary unit 4 temporarily halts its rotation. The state detection unit 14 detects the state of the development device 11C, which has been temporarily stopped at the detection position and is assigned to the C-color component, or the state of the toner cartridge 13C of the development device 11C.

Figure 3E:
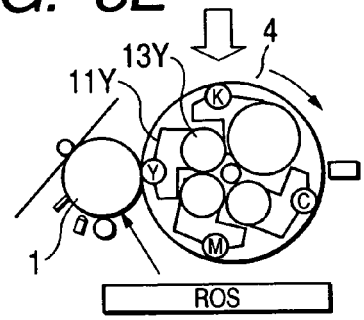
Figure 3A:
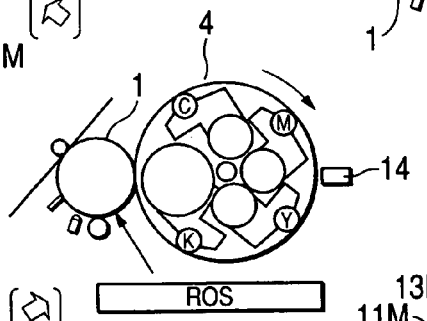

As shown in FIG. 3E, after detecting the state in connection with the C-color component has been completed, the development device 11Y assigned to the Y-color component arrives at the development position as a result of rotation of the rotary unit 4 being resumed. Thereby, the development device 11Y assigned to the Y-color component can develop the electrostatic latent image on the photosensitive drum 1.

Figure 3F:
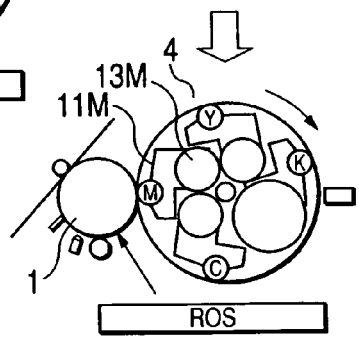

After operation for developing the electrostatic latent image of K-color component has been completed, the rotary unit 4 resumes its rotation. As shown in FIG. 3F, the development device 11M assigned to the M-color component arrives at the development position as a result of rotation of the rotary unit 4. Thereby, the development device 11M assigned to M-color component becomes able to develop the electrostatic latent image on the photosensitive drum 1.

Figure 3I:
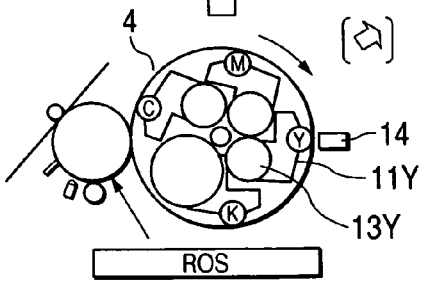
Figure 3H:
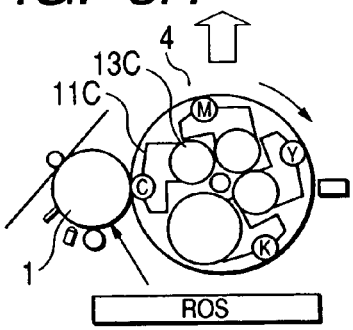
Figure 3G:
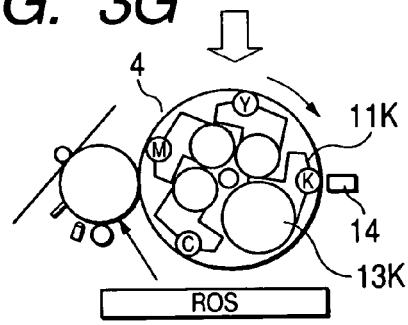

As shown in FIG. 3G, after operation for developing the electrostatic latent image of the M-color component has been completed, the development device 11K assigned to the K-color component arrives at the detection position as a result of rotation of the rotary unit 4 being resumed. Here, the rotary unit 4 temporarily halts its rotation. The state detection unit 14 detects the state of the development device 11K, which has been temporarily stopped at the detection position and is assigned to the K-color component, or the state of the toner cartridge 13K of the development device 11K.

After detecting the state in connection with the K-color component has been completed, the rotary unit 4 resumes its rotation. As shown in FIG. 3H, the development device 11C assigned to the C-color component arrives at the development position as a result of rotation of the rotary unit 4. Thereby, the development device 11C assigned to C-color component becomes able to develop the electrostatic latent image on the photosensitive drum 1.

As shown in FIG. 3I, after operation for developing the electrostatic latent image of C-color component has been completed, the development device 11Y assigned to the Y-color component arrives at the detection position as a result of rotation of the rotary unit 4 being resumed. Here, the rotary unit 4 temporarily halts its rotation. The state detection unit 14 detects the state of the development device 11Y, which has been temporarily stopped at the detection position and is assigned to the Y-color component, or the state of the toner cartridge 13Y of the development device 11Y.

After operation for developing the electrostatic latent image of Y-color component has been completed, the rotary unit 4 has finished rotating once. Subsequently, when an image for the next page must be continuously formed, a round of processing operations pertaining to the above-described respective colors is repeatedly performed from operation for detecting the state of the M-color component (see FIG. 3B). If an image does not need to be continuously formed, the rotary unit 4 halts its rotation while being in the home position (see FIG. 3A), and enters a standby condition for awaiting the next processing operation.

As mentioned above, the image forming apparatus of the present embodiment carries out state detection to be performed by the state detection unit 14 during the same rotation as that of the rotary unit 4 performed for developing an electrostatic latent image on the photosensitive drum 1. In more detail, rotation of the rotary unit for developing an electrostatic latent image and rotation of the rotary unit for detecting the state of each of the development devices 11, which are originally performed separately for different purposes, are carried out during the same rotation. Therefore, even when the image forming apparatus has the state detection unit 14 and the state detection unit detects the state of the development device 11 or the state of the toner cartridge 13 of the development device, individual rotation of the rotary unit for detecting the state is not required.

Consequently, the image forming apparatus of the present embodiment yields an advantage of the ability to prevent occurrence of a drop in productivity pertaining to image formation while formation of a superior image is enabled by detection of the state of the development device 11 or the like. Moreover, the state detection to be performed by the state detection unit 14 is carried out during the same rotation as that of the rotary unit 4 to be performed for developing an electrostatic latent image on the photosensitive drum 1. Hence, detection of a state can be performed in real time during operation for developing an electrostatic latent image. Further, there is also yielded an advantage of the ability to prevent occurrence of a state where an image cannot be formed because of a lag in control.

These advantages are extremely effective, particularly for the case where the development devices 11 are attached to the rotary unit 4 at nonuniform pitches. In the case of nonuniform pitches, when any one of a plurality of the development devices 11 is situated at the development position, the positions of the other development devices are changed according to which one of the development devices 11 is located at the development position. Put another way, the locations where the other development devices 11 remain stationary do not become constant, because of the nonuniform pitches. For this reason, in the case of the nonuniform pitches, operation for developing an electrostatic latent image and operation for detecting a state cannot be performed at the same rotary stop position. Therefore, rotation of the rotary unit for developing an electrostatic latent image and rotation of the rotary unit for detecting the state of the development device 11 are usually performed independently. However, as described in connection with the present embodiment, even in the case of nonuniform pitches, so long as processing is performed in the sequence of: the home position→detection of state of an M-color component→operation for developing an electrostatic latent image of a K-color component→detection of a C-color component state→operation for developing an electrostatic latent image of Y-color component→operation for developing an electrostatic latent image of an M-color component→detection of the state of a K-color component→operation for developing an electrostatic latent image of a C-color component→operation for developing an electrostatic latent image of a Y-color component (see FIGS. 3A-3G); namely, so long as processing of the development device 11 is performed when any one of the development devices 11 has arrived at the development position or the detection position, operation for developing an electrostatic latent images of respective color components and detection of the state of each of the development devices 11 can be performed during the same rotation of the rotary unit 4. Namely, even in the case of the nonuniform pitches, so long as processing of the respective development devices 11 is performed in sequence of arrival at the development position or the detection position during the same rotation of the rotary unit, a superior image can be formed by detection of the state of the respective development devices 11, and occurrence of a drop in productivity pertaining to image formation can be prevented.

As described in connection with the present embodiment, so long as rotation of the rotary unit 4 is temporarily stopped for causing the state detection unit 14 to perform state detection every time any one of the development devices 11 arrives at the detection position and so long as the state of the thus-stopped development device 11 or the state of the toner cartridge 13 thereof is detected, a sufficient time for detecting the state can be ensured. Consequently, the accuracy and reliability of state detection can be maintained at high levels, and formation of a superior image can be realized without fail.

When rotation of the rotary unit is halted at the detection position, rotation of the rotary unit is performed during the same rotation as that of the rotary unit performed for developing an electrostatic latent image. Therefore, there arises a conceivable increase in the time required to rotate the rotary unit for developing an electrostatic latent image.

Meanwhile, rotation of the rotary unit for developing an electrostatic latent image must be performed at timing when the toner images of respective colors precisely overlap each other on the intermediate transfer belt 5. Specifically, the time required by rotation of the rotary unit is dependent on the timing when an image is transferred from the photosensitive drum 1 to the intermediate transfer belt 5.

Consequently, when rotation of the rotary unit is temporarily halted at the detection position, changing the timing—when an image is transferred from the photosensitive drum 1 to the intermediate transfer belt 5—in accordance with the temporary halt is also conceivable. Specifically, the rotational speed of the photosensitive drum 1 and operating speed of the intermediate transfer belt 5 may be decreased to make larger an interval between the images of colors to be transferred.

[Description of Another Example Processing Operation]

Another example processing operation of the image forming apparatus will now be described. Only a difference between the present example processing operation and the previously-described example processing operation is now described.

The processing operation to be described here differs from the previously-described example processing operation in that rotation of the rotary unit is not temporarily stopped at the detection position and that the state detection unit 14 detects a state during rotation of the rotary unit 4 specifically, the state detection unit 14 detects the state of the development device 11 that passes by the detection position, or the state of the toner cartridge of that development device 11, by rotation of the rotary unit 4.

As mentioned above, so long as detection of a state is performed during rotation of the rotary unit, even when detection of the state is performed during the same rotation as that of the rotary unit for developing an electrostatic latent image, an increase in the time caused by rotation of the rotary for developing an electrostatic latent image can be avoided. Therefore, detection of a state is very effective for preventing occurrence of an drop in productivity pertaining to image formation.

When a state is detected during rotation of the rotary unit, there may arise a failure to ensure a sufficient time for detecting a state. Since the time allotted to detecting a state becomes shorter, acquiring a correct output value from the detection signal produced by the state detection unit 14 is considered to become difficult.

For these reasons, when a state is detected during rotation of the rotary unit, the state detection unit 14 is preferably provided with a peak-hold circuit for holding a peak in a detection signal produced by the state detection unit 14. The peak-hold circuit may extract and hold a peak value of the signal, and the peak hold circuit is preferably configured from a known electrical circuit. The peak-hold circuit may be formed not from a hardware configuration based on an electrical circuit, but from a software configuration.

Figure 4:
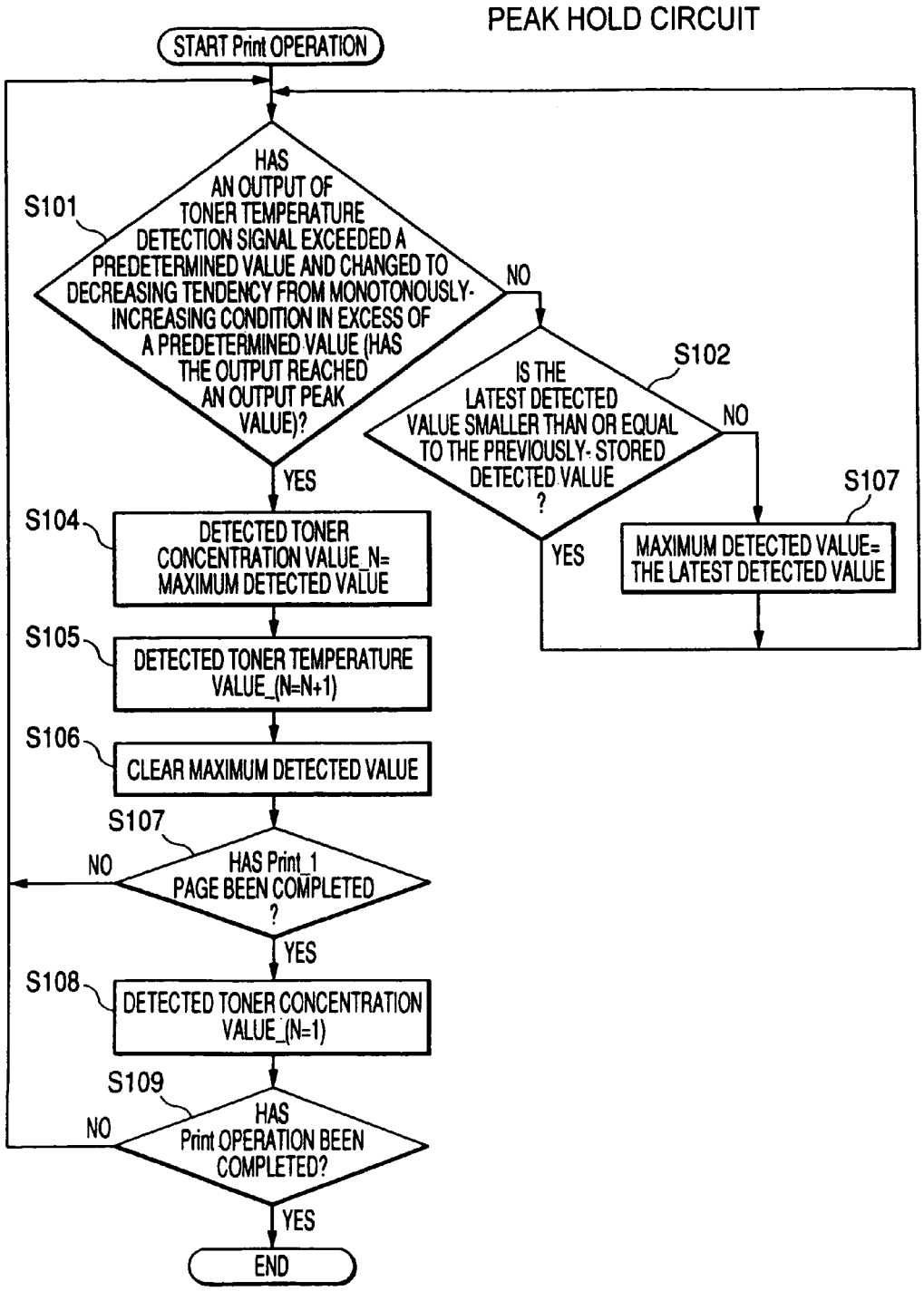
FIG. 4 is a flowchart showing example processing operation of a peak-hold circuit embodied by a software configuration.

FIG. 4 is a flowchart showing an example processing operation of the peak-hold circuit implemented by the software configuration. As illustrated, for instance, when the state detection unit 14 detects the concentration of toner, the state detection unit 14 detects the state of the development device 11 passing by the detection position or the state of the toner cartridge 13 of the development device 11. Upon output of a toner concentration detection signal, which is a result of detection of the state, the peak-hold circuit determines whether or not an output value of the toner concentration detection signal has become a decreasing tendency from a monotonously-increasing state or whether or not an output peak value has been achieved (step 101, wherein a step is hereunder abbreviated as "S"). When the output peak value has not been achieved, an output peak value is monitored while the latest detected value is taken as the maximum detected value (S102, S103) in a case where the latest detected value is lower than or equal to the detected value for which the latest detected value has already been stored. Meanwhile, when the peak value has been achieved, the maximum detected value is taken as a toner concentration detected value while being updated (S104 to S107). These processing operations are repeated until the image forming operation is completed (S108, S109).

If such a peak-hold circuit is provided, even when a state is detected during rotation of the rotary unit; namely, when a sufficient time to detect a state cannot be ensured, a peak value of a detection signal obtained by state detection operation is held. Accordingly, a correct output value of the detection signal can be obtained, and the accuracy and reliability of state detection operation to be performed by the state detection unit 14 can be enhanced while occurrence of a drop in productivity pertaining to image formation is prevented.

[Description of Still Another Example Processing Operation]

Still another example processing operation of the image forming apparatus will now be described. In the present example, only a difference between the present example processing operation and the previously-described example processing operations is described, as well.

The processing operation to be described here differs from the previously-described example processing operations in that, when the state detection unit 14 detects a state, detection of a state is performed during the same rotation as that of the rotary unit for developing an electrostatic latent image, but the state detection unit 14 does not always detect a state; and in that rotation of the rotary unit for effecting detection of a state and operation for developing an electrostatic latent image and rotation of the rotary unit solely for developing an electrostatic latent image without involvement of detection of a state are selectively performed. Switching between rotation of the rotary unit for detecting a state and developing an electrostatic latent image and rotation of the rotary unit solely for developing an electrostatic latent image without involvement of detection of a state can be effected.

In order to effect switching, the way to effect switching; namely, a standard for switching, is necessary. However, the switching standard includes standards which will be provided below.

In general, the length of the intermediate transfer belt 5 is unique to the apparatus but is constant and not a variable amount. The operating speed of the photosensitive drum 1, that of the intermediate transfer belt 5, and that of the rotary unit 4, all of which operate in conjunction with each other, are constant amounts and unique to the apparatus. In contrast, the size of an image transferred on the intermediate transfer belt 5 is a variable quantity which varies according to the size of a formed image (the size of an output medium). Consequently, in contrast with a case where an image of the largest possible size is formed, when an image—smaller than the largest possible size—is formed, a leeway arises during a period from when formation of an image of a certain color component has been completed until formation of an image of another color component is started. This signifies that a leeway also arises in the time required to rotate the rotary unit 4. Namely, even when rotation of the rotary unit is temporarily stopped in, e.g., the detection position, to thus detect a state, by virtue of existence of the leeway, before start of operation for developing an electrostatic latent image of the next color component after completion of operation for developing an electrostatic latent image of a certain color component, operation for developing the electrostatic latent image of the next color component can be conceived to be started appropriately.

Therefore, the state detection unit 14 and the rotation control unit for controlling the rotational driving of the rotary unit 4 make switching between operation of rotating the rotary unit for detecting a state and for developing an electrostatic latent image and operation of rotating the rotary unit solely for developing an electrostatic latent image, in accordance with a predetermined allowable time determined on the basis of conditions for image formation, such as the operating speed of the photosensitive drum 1, that of the intermediate transfer belt 5, that of the rotary unit 4, and the size of image formation.

Specifically, a predetermined allowable time is compared with a total time, the total time including a time required by the state detection unit 14 to detect a state during the period of a time that elapses from the time of the development device located in the development position having finished developing an electrostatic latent image on the image carrier until the time of the next development device for developing an electrostatic latent image on the image carrier moving to the development position, and a time required by the state detection unit to perform state detection. When the total time exceeds the allowable time, rotation intended solely for developing an electrostatic latent image is performed. When the total time falls within the allowable time, rotation including state detection to be performed by the state detection unit 14 is performed. So long as the total time falls within the allowable time, the development device of the next color can be rotationally moved to the development position without involvement of a drop in productivity pertaining to image formation even when the state detection unit 14 detects a state.

Figure 5:
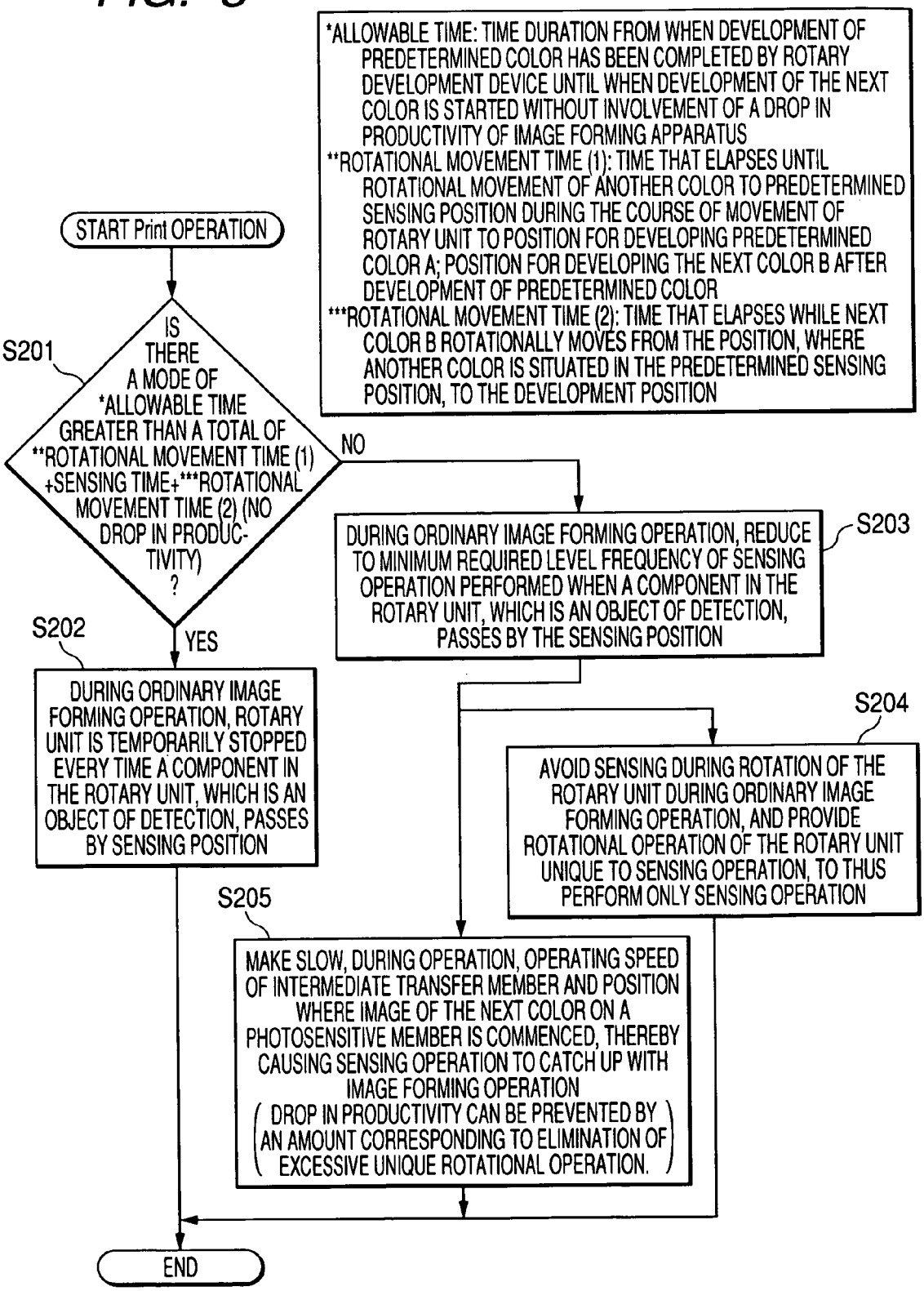
FIG. 5 is a flowchart showing example processing operation performed when rotation of a rotary unit is selectively switched.

FIG. 5 is a flowchart showing an example processing operation performed when rotation of the rotary unit is selectively switched. As illustrated, the rotation control unit or a higher-level control unit that imparts an operation command to the rotation control unit compares the allowable time with the total time when operation for forming an image is commenced (S201). When the total time falls within the allowable time, rotation of the rotary unit, including detection of a state performed by the state detection unit 14, is performed (S202). When the total time exceeds the allowable time, rotation of the rotary unit intended solely for developing an electrostatic latent image is performed (S204) in order to reduce the frequency of detection of a state performed by the state detection unit 14 to the minimum required level (S203). At this time, if possible, timing at which an image is transferred from the photosensitive drum 1 to the intermediate transfer belt 5 may be changed to thus detect a state (specifically, temporarily stop rotation of the rotary unit to the detection position) rather than the state detection operation by the state detection unit 14 not being performed (S205).

As mentioned above, so long as the rotation of the rotary unit is subjected to selective switching, detection of a state can be performed at the maximum frequency appropriate to the necessity (close to every page) under the conditions for image formation where no drop arises in productivity even when a state is detected by halting the rotary at the detection position. Meanwhile, under conditions for image formation involving a drop in productivity, rotation of the rotary unit intended solely for developing an electrostatic latent image is performed in a concentrated manner, thereby avoiding occurrence of a drop in productivity pertaining to formation of an image, which would otherwise arise when detection of a state is performed. Consequently, the present example is very suitable for making an attempt to prevent a reduction in productivity pertaining to image formation while formation of a superior image is made possible by detecting a state.

Selective switching of rotation of the rotary unit is very effectively applied to a case where a state is detected by temporarily halting rotation of the rotary unit at the detection position. Even when detection of a state is performed during rotation of the rotary unit without involvement of a temporary stop, similar application of the present example is also conceivable. Even when state detection operation is performed during rotation of the rotary unit, an attempt can be made to reduce processing load stemming from detection of a state, so long as the state detection to be performed by the state detection unit 14 is selectively performed. This can eventually contribute to prevention of a drop in productivity pertaining to image formation.

Although the specific preferred examples have been described by reference to various example configurations and processing operations, the present invention is not limited to the specifics of the embodiments.

For instance, even the image forming apparatus compatible with a color image operates in a mode for forming a monochrome image. Specifically, there is a case where anyone of a plurality of the development devices 11; specifically, only the development device compatible with a K-color component, is compatible with a mode for developing an electrostatic latent image. In that case, it is conceivable to subject only the development device responsible for operation of developing an electrostatic latent image or the constituent unit of the development device; specifically, the development device assigned to the K-color component, to state detection operation performed by the state detection unit 14 rather than to equally subject all the development devices 11 to state detection operation performed by the state detection unit 14. As mentioned above, so long as a limitation is imposed on the target to be subjected to the state detection operation performed by the state detection unit 14, an attempt can be made to reduce processing load stemming from state detection operation.

In many cases, the image forming apparatus has prediction unit for predicting occurrence of a change in the state of the development device or the state of a constituent unit of the development device. Specifically, in the case of, e.g., the amount of remaining toner, an available prediction unit retains and accumulates history information about the number of pixels of a processed image, the number of mediums, a cumulative operation time of the apparatus, or the like; predicts the amount of remaining toner on the basis of the history information; and produces an alarm output when the predicted amount of remaining toner has become lower than the allowable amount of toner. In the case of an image forming apparatus having such prediction unit, the state detection unit 14 does not always perform state detection operation. It is conceivable to cause the state detection unit 14 to perform state detection operation after the prediction unit has predicted that the state of the development device or the state of a constituent unit of the development device may have changed to a monitoring-required state (e.g., a state when the predicted amount of remaining toner has become lower than the allowable amount in the case of the amount of remaining toner), or to effect the previously-described selective switching between the rotations of the rotary unit. Since the necessity for the state detection unit 14 to perform state detection operation is not great before the condition changes to the monitoring-required condition, the state detection unit 14 does not perform state detection operation before the monitoring-required state is achieved. As a result, an attempt can be made to reduce processing load until the monitoring-required state is achieved.

Moreover, in a case where the prediction unit is provided for each of the development devices 11, the state detection unit 14 does not indiscriminately detect the states of all development devices 11, but it is also conceivable to cause the state detection unit 14 to detect the state of only the development device, which has been predicted to have changed to the monitoring-required state by the prediction unit, or the state of a constituent unit of the development device. The development devices, which are not in the monitoring-required condition, do not have to undergo state detection operation performed by the state detection unit 14. By limitations being imposed on a target to be subjected to state detection operation performed by the state detection unit 14, an attempt can be made to reduce processing load stemming from state detection.

As mentioned above, the present invention is susceptible to modifications of the embodiments within the scope of the gist of the present invention.

As described above, according to an aspect of the present invention, an image forming apparatus comprises: a rotary unit having a plurality of development devices provided around a rotary shaft, the development device including a constituent unit, wherein the plurality of the development devices move to a development position where the development devices sequentially oppose an image carrier by rotation of the rotary unit, and the development device in the development position develops an electrostatic latent image on the image carrier, a state detection unit that is disposed at a position above a circumference of the rotary unit, the position being different from the development position and that detects at least one of a state of the development devices and a state of the constituent unit of the development devices; and a rotation control unit that controls the rotary unit so as to perform rotation of the rotary unit for sequentially moving the development devices to the development position and rotation of the rotary unit for sequentially moving the development devices to a detection position during the same rotation.

According to another aspect of the invention, the plurality of development devices are arranged on a circumference of the rotary unit at nonuniform pitches.

According to another aspect of the invention, the rotation control unit temporarily halts rotation of the rotary unit for causing the state detection unit to detect a state every time any one of the plurality of the development devices has arrived at the detection position; and the state detection unit detects the state of the development device temporarily stopped at the detection position or the state of a constituent unit of the development device.

According to another aspect of the invention, timing at which an image formed on the image carrier is transferred to an intermediate transfer body is changed according to temporary halt of rotation of the rotary unit.

According to another aspect of the invention, the state detection unit detects at least one of the state of a development device and the state of the constituent unit of the development devices passing the detection position by rotation of the rotary unit.

According to another aspect of the invention, the image forming apparatus further comprises: a peak hold circuit that holds a peak of a detection signal obtained by the state detection unit.

According to another aspect of the present invention, the rotation of the rotary unit solely for developing the electrostatic latent image on the image carrier and the rotation of the rotary unit for both developing the electrostatic latent image on the image carrier and detecting at least one of the state of the development devices and the state of the constituent unit by the state detection unit are selectively performed.

According to another aspect of the invention, the state detection unit detects the state between a time that the developing device in the development position finishes developing the electrostatic latent image on the image carrier and a time that the next developing device arrives at the developing position, and a total time of the time required to detect the state by the state detection unit and the elapsed time between the time that the developing device in the development position finishes developing and the time that the next developing device arrives at the developing position is compared with a predetermined allowable time identified by a condition of image forming, and when the total time exceeds the allowable time, a rotation only for developing an electrostatic latent image on the image carrier is performed, and when the total time falls within the allowable time, a rotation including state detection by the state detection unit is performed.

According to another aspect of the invention, in a mode that only one development device among the plurality of development devices develops an electrostatic latent image on the image carrier, the state detection is performed only against the development device that develops the electrostatic latent image or against the constituent unit included in the development device.

According to another aspect of the invention, the image forming apparatus further comprising: a prediction unit that predicts a change in the state of the development device or the state of the constituent unit of the development device, wherein, when the prediction unit predicts that the state of the development device or the state of the constituent unit of the development device changed to a monitoring-required state, the state detection unit performs state detection operation.

According to another aspect of the invention, the prediction unit is provided individually for each of a plurality of the development devices, and only the development device or the constituent unit of the development device, whose state is predicted to have changed to the monitoring-required state, is subjected to state detection to be performed by the state detection unit.

According to the aspect, the state detection unit detects at least one of the state of the development devices attached to the rotary unit and the state of constituent units of the development devices. The "state of the development device" refers to the state of a matter which affects operation for developing an electrostatic latent image. Specifically, the state of the development device includes the concentration of toner used for developing an electrostatic latent image or the amount of remaining toner, presence/absence of the development device on the rotary unit, and specifics of attribute information stored in and retained by the development device. Likewise, the "state of a constituent unit of the development device" refers to the state of a matter which affects operation for developing an electrostatic latent image. Specifically, the state of a constituent unit includes the state of a toner cartridge comprising the development device, such as presence/absence of the toner cartridge. Since "at least one of the states" may be detected, detecting any one of the above-described matters and detecting the states of plural matters in combination are acceptable.

Furthermore, the image forming apparatus performs state detection to be performed by the state detection unit during the same rotation as that of the rotary unit for developing an electrostatic latent image on the image carrier. Here, the term "same rotation" means an identical single rotation. Specifically, when the rotary unit has rotated once, the respective development devices sequentially move to the development position, so that each of the development devices becomes able to develop an electrostatic latent image on the image carrier. However, in association with sequential movement, the respective development devices sequentially move to the detection position. Accordingly, at a point in time when the respective development devices have moved to the detection position, the state detection unit detects the state of the development device situated in the detection position. At that time, rotation of the rotary unit is temporarily stopped when the development device has moved to the detection position. If state detection to be performed by the state detection unit is possible, the development device may merely pass by the detection position without involvement of a temporary stop.

Consequently, even when the image forming apparatus has the state detection unit and detects the state of the development device or a constituent unit of the development device, individual rotation of a rotary for detecting the state is not required.

According to the above-examples, even when the state of a development device or the state of a constituent unit of the development device is detected, individual rotation of a rotary for detecting the state is not required. Hence, occurrence of a drop in productivity pertaining to image formation is prevented while formation of a superior image is enabled by detecting the state of the development device or the like. Further, state detection to be performed by the state detection unit is effected during the same rotation as that of the rotary unit for developing an electrostatic latent image on the image carrier. Hence, the state of a development device, or the like, can be detected in real time during operation for developing an electrostatic latent image. Occurrence of a state inappropriate for forming an image because of a delay in control (occurrence of a failure in image quality or the like) or occurrence of a state where formation of an image is impossible may be prevented.

What is claimed is:

1. An image forming apparatus comprising:

a rotary unit having a plurality of development devices provided around a rotary shaft, the development device including a constituent unit, wherein the plurality of the development devices move to a development position where the development devices sequentially oppose an image carrier by rotation of the rotary unit, and the development device in the development position develops an electrostatic latent image on the image carrier, a state detection unit disposed at a position outside of a circumference of the rotary unit, the position being different from the development position, the state detection unit detects at least one of a state of the development devices and a state of the constituent unit of the development devices; and a rotation control unit that controls the rotary unit so as to effect rotation of the rotary unit for sequentially moving the development devices to the development position and to a detection position during the same rotation, wherein a detection of the state by the state detection unit and the development of the electrostatic latent image on the image carrier by the development devices are performed in the same rotations, wherein the rotation of the rotary unit solely for developing the electrostatic latent image on the image carrier and the rotation of the rotary unit for both developing the electrostatic latent image on the image carrier and detecting at least one of the state of the development devices and the state of the constituent unit by the state detection unit are selectively performed, wherein the state detection unit detects the state between a time that the developing device in the development position finishes developing the electrostatic latent image on the image carrier and a time that the next developing device arrives at the developing position, and a total time of the time required to detect the state by the state detection unit and the elapsed time between the time that the developing device in the development position finishes developing and the time that the next developing device arrives at the developing position is compared with a predetermined allowable time identified by a condition of image forming, and when the total time exceeds the allowable time, a rotation only for developing an electrostatic latent image on the image carrier is performed, and when the total time falls within the allowable time, a rotation including state detection by the state detection unit is performed.

* * * * *